United States Patent [19]

Radvan et al.

[11] 4,427,491

[45] Jan. 24, 1984

[54] APPARATUS FOR CONTROLLING THE DEPOSITION OF A LIQUID ON TO A MOVING SURFACE

[75] Inventors: Bronislaw Radvan, Flackwell Heath; Vaughan W. Punton, Beaconsfield; Paul B. Trendall, High Wycombe, all of England

[73] Assignee: The Wiggins Teape Group Limited, England

[21] Appl. No.: 379,520

[22] Filed: May 18, 1982

Related U.S. Application Data

[63] Continuation of Ser. No. 123,763, Feb. 2, 1980, Pat. No. 4,345,970.

[30] Foreign Application Priority Data

Feb. 28, 1979 [GB] United Kingdom ..... 7907124

[51] Int. Cl.[3] ..... D21F 1/02

[52] U.S. Cl. ..... 162/299; 162/344; 118/407

[58] Field of Search ..... 162/123, 213, 212, 317, 162/334, 339, 340, 344, 346, 347, 297, 295, 214, 125, 298, 299; 239/523; 427/424; 118/407, 413, 415

[56] References Cited

U.S. PATENT DOCUMENTS

| | | | |
|---|---|---|---|
| 1,641,987 | 9/1927 | Niks . | |
| 2,203,802 | 6/1940 | Thaler . | |
| 2,718,824 | 9/1955 | Hornbostel . | |
| 2,855,895 | 10/1958 | Burns et al. | 118/407 |
| 2,933,061 | 4/1960 | Galer | 118/711 |
| 3,072,180 | 1/1963 | Jodrey . | |
| 3,536,582 | 10/1970 | Amneus | 162/344 |
| 3,619,362 | 11/1971 | Parker | 162/301 |
| 3,627,564 | 12/1971 | Mercier | 118/411 |
| 3,846,230 | 11/1974 | Wahren et al. | 162/344 |
| 4,021,296 | 5/1977 | Reiner | 162/344 |
| 4,083,750 | 4/1978 | Newns et al. | 162/344 |
| 4,125,429 | 11/1978 | Hergert et al. | 162/344 |
| 4,133,713 | 1/1979 | Chuang | 162/343 |
| 4,162,189 | 7/1979 | Kirjauainen | 162/347 |

FOREIGN PATENT DOCUMENTS

| | | | |
|---|---|---|---|
| 949368 | 6/1974 | Canada . | |
| 2031994 | 11/1970 | France . | |
| 705665 | 3/1954 | United Kingdom . | |
| 1143604 | 2/1969 | United Kingdom | 162/343 |

*Primary Examiner*—William F. Smith

*Attorney, Agent, or Firm*—Burns, Doane, Swecker & Mathis

[57] ABSTRACT

A jet of liquid (3) is deposited from a reservoir outlet (2) on to a moving surface (4) located below the outlet. Deposition is effected by discharging a jet of the liquid on to the underside of a curved guide member (5) which is disposed between the outlet and the moving surface and which is oriented so as to cause the liquid to flow down the member on its underside so that its direction of flow approaches the direction of travel of the moving surface.

The invention is particularly advantageous in the production of paper webs, especially multi-layer paper webs on a Fourdrinier paper-making machine.

7 Claims, 11 Drawing Figures

APPARATUS FOR CONTROLLING THE DEPOSITION OF A LIQUID ON TO A MOVING SURFACE

Figure 1:
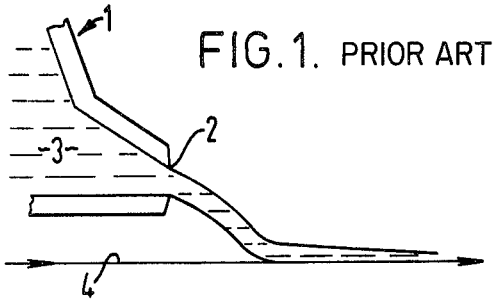
FIG. 1. PRIOR ART

This application is a continuation of application Ser. No. 123,763, filed Feb. 2, 1980, U.S. Pat. No. 4,345,970.

This invention relates to a process and apparatus for controlling the deposition of a liquid on to a moving surface.

In the field of papermaking, it is often necessary to deposit a liquid, which may contain a dispersion of solids eg fibres, on to a moving surface, for example in forming, coating or impregnating a paper web. However, the manner in which such deposition has hitherto been made has resulted in a number of disadvantages described below.

1. The formation of a web of paper on a Fourdrinier machine is achieved by allowing papermaking stock to flow freely from the slice of a head box (a reservoir outlet) on to a moving wire which retains the fibres while allowing the water to drain through. During the process of formation, fibres on the wire side of the web tend to be oriented in the machine direction whereas fibres on the upper side are generally oriented in a more random fashion. This difference in fibre orientation results in a paper web having an undesirable tendency to curl.

2. The production of paper webs of commercially acceptable uniformity requires that the jet of stock be discharged from the slice not only in the same direction as the moving wire but also at substantially the same speed. This latter requirement is usually achieved by maintaining the level of stock in the head box at a particular height above the slice. But, for high speed production, i.e. at speeds in excess of 500 m/min, the hydrostatic head at the slice must be augmented by pressurising the inside of the head box, because otherwise the required height is so great as to necessitate the use of a very large and unwieldy head box construction. Even so, the head box still has to be constructed to withstand the increased internal pressure, and as a result becomes progressively more sturdy and therefore more expensive as the speed and the corresponding intensity of pressure are increased. In addition, the pressurising of the inside of the head box requires expensive air pressure supply and control devices.

3. The production of a multi-layer web on a Fourdrinier machine requires successive deposition of stocks on to the wire from a series of head boxes. Secondary and any successive head boxes are suspended clear above the wire but at a practicable minimum height of, for example, 2 to 5 cm. However, if stock is deposited onto a layer which is incompletely drained and not held down by suction on to the wire, then the layer tends to disrupt in a gross manner because of the impact with which the stock hits the layer. If the layer is completely drained and held down on the wire before the stock is deposited thereon, then the drainage of the water through the layer takes an excessively long time and the bonding between the layers is generally poor.

4. During the papermaking process it is frequently necessary to apply, for instance, coating mixes, dyes, solutions of binders, sizes, and/or chemical additives on to the surface of a moving web, such as a wet paper web. At present, such coating or impregnating operations are carried out with the aid of a spray, a roll or a size press, or a secondary head box. However, sprays do not evenly distribute the liquid over the web and tend to become blocked particularly when the liquid contains a dispersion of solids. With size presses and rolls, such as dandy rolls, the amount of coating or impregnating liquid which can be applied to a web is limited by the disruption casued to its surface when the roll separates therefrom. And with secondary head boxes, it is desirable to apply the liquid as a foam in order to minimise disruption of the web, in which case undesirable chemicals may have to be added.

It is an object of the present invention to provide a process and apparatus which overcome or have the capability to overcome or at least substantially to reduce the above disadvantages.

Accordingly, the present invention provides in a first aspect a process for controlling the deposition of a liquid from a reservoir outlet onto a moving surface located below the outlet, which process includes discharging a jet of the liquid from the outlet on to the underside of a downwardly extending curved guide member which is disposed between the outlet and the moving surface and which is oriented so as to cause the liquid to flow down the member on its underside so that its direction of flow approaches the direction of travel of the moving surface.

In a second aspect, the present invention provides apparatus for controlling the deposition of a liquid on to a moving surface, comprising a reservoir having an outlet, and a curved guide member downwardly extending from above and adjacent to the outlet and having an curved underside on to which a jet of liquid can be discharged from the outlet, the guide member being oriented so as to be capable of causing the liquid to flow down the member on its underside so that its direction of flow approaches the direction of travel of the moving surface.

In particular, the present invention provides a head box assembly for controlling the deposition of papermaking stock on to the moving wire of a paper-making machine, which assembly comprises a head box having a slice and a curved guide member downwardly extending from above and adjacent to the slice and having an underside on to which a jet of paper-making stock can be discharged from the slice, the guide member being oriented so as to be capable of causing the stock to flow down the member on its underside so that its direction of flow approaches the direction of travel of the moving wire.

The process of the present invention is most advantageous if contact of the liquid with the moving surface is achieved prior to the liquid leaving the guide member. However, included within the scope of the invention is the possibility that the liquid leaves the guide member first and then contacts the moving surface. Although this possibility is less preferred, it does represent an improvement over the prior art methods of liquid deposition since the height through which the liquid freely falls can be reduced significantly.

Preferably, the underside of the guide member is convex to the liquid, and the jet meets the convex surface substantially tangentially thereto. Also, it is further preferred that the liquid leaves the convex surface at a point whose tangent is substantially parallel to the direction of the moving surface.

The underside of the guide member is generally plain. Alternatively, the underside may have a plurality of recesses or steps disposed in a direction transverse to the direction of flow of the liquid.

In the most preferred form, the guide member is a flexible plate with a plain underside and a length and/or radius of curvature which is capable of adjustment. Also, to facilitate the attainment of the most suitable orientation of the guide member relative to the jet and the moving surface, the member is preferably capable of pivotal movement about an axis transverse to the direction of flow of the liquid.

When the moving surface is convex to the liquid, the underside of the guide member is advantageously concave to the liquid.

Although the guide member is preferably secured to the reservoir, the present invention includes within its scope the possibility that the guide member is separate from the reservoir. In this latter arrangement, an impermeable web may be secured with advantage at one end to the outlet and at the other end to the guide member so as to stabilize the jet therebetween. Further stabilization of the jet may be achieved by allowing the web to be concave thereto.

It is believed that when the underside of the guide member is convex, the liquid is retained thereon by the Coanda effect but when the underside of the guide member is concave the liquid is retained thereon by the reverse of the Taylor instability effect. However, the physics of the systems have not been completely elucidated and the applicants do not wish to be bound by any particular theory relating thereto.

The stability of the jet may be substantially improved by the use of a flexible impermeable apron attached at one end to the bottom of the outlet and free at the other. A further significant improvement can be achieved by the provision of a pair of side plates which extend downwardly from the guide member so as to retain the liquid between the two side plates. An even further improvement in the jet's stability, particularly as it is discharged from the outlet, as be achieved by employing a recess in the wall of the outlet over which the jet flows, the recess extending transversely to the direction of flow of the liquid.

Although the process of the present invention has been described herein with particular reference to the formation, coating or impregnation of webs, especially paper webs, it is not limited thereto, but has application in any field where there is a need for controlled deposition of a liquid onto a moving surface. It is however very suited to the production of paper on a Fourdrinier machine, particularly multi-layer paper.

The present invention will now be further described with reference to a number of specific embodiments which should not be construed as limiting the scope of the invention in any way.

Figure 7:
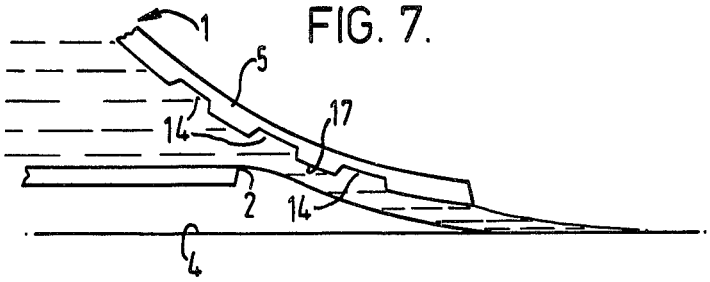
Figure 8:
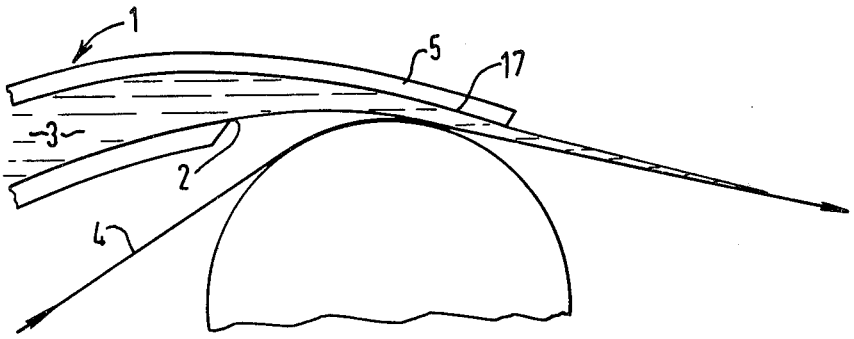
Figure 9:
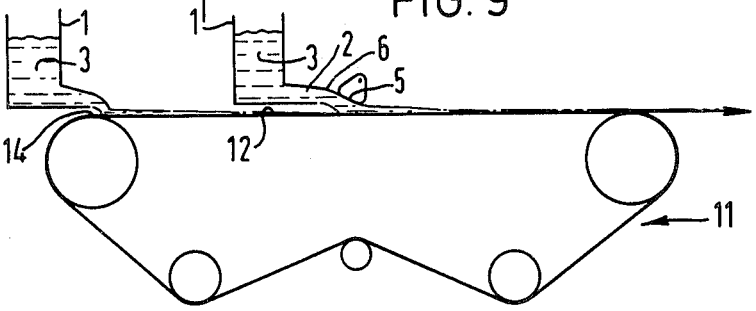
Figure 10:
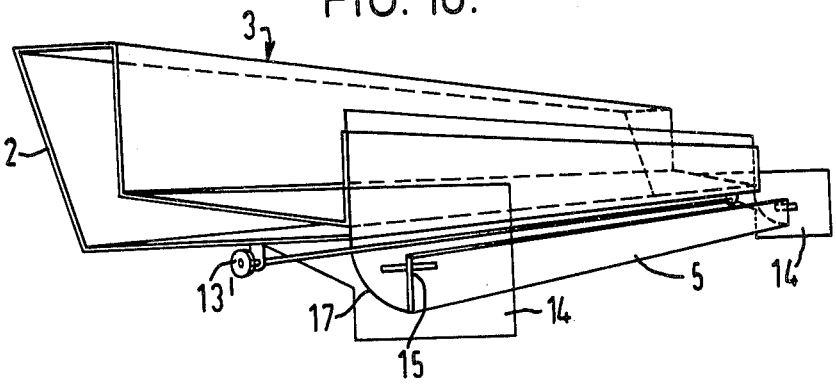
Figure 11:
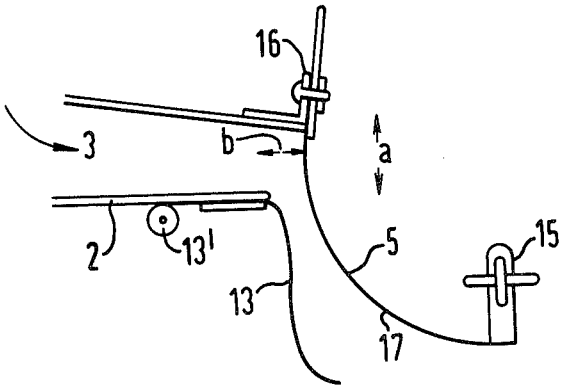

Referring to the drawings,

FIG. 1 shows a conventional apparatus with a reservoir outlet positioned above a moving surface, FIGS. 2 to 8 show various apparatuses in accordance with the invention, FIG. 9 shows, in part, a Fourdrinier paper machine adapted for use according to the invention, FIG. 10 shows, in perspective, part of a preferred head box assembly in accordance with the invention, and FIG. 11 shows a more detailed end view of the head box assembly of FIG. 10 but with the side plates and part of the slice removed.

FIGS. 1 to 8 show apparatuses comprising a reservoir 1, in part, having an outlet 2 through which liquid 3 may flow. A surface 4 moving in the direction indicated is located below and spaced apart from a lower surface of the outlet 2.

With the apparatus shown in FIG. 1, a jet of liquid 3 is discharged from the outlet 2 and is deposited directly on to the moving surface 4—there is no control over the deposition, the jet of liquid 3 falling freely from the outlet 2 on to the surface 4. In contrast, with the apparatuses shown in FIGS. 2 to 8, the jet of liquid 3 is discharged from the outlet 2 on to the curved underside 7 of a downwardly extending curved guide member 5 which controls deposition of liquid 3 on to the moving surface 4 by causing it to flow down the underside 17 of the guide member 5 so that its direction of flow approaches the direction of travel of the moving surface 4. According to the present invention, an end of the guide member 5 remote from the reservoir outlet 2 is arranged in a predetermined fixed spaced relationship from the moving surface 4. A lower surface of the jet is exposed to ambient pressure during flow along the underside surface of the guide member 5 (see also FIG. 9).

Figure 2:
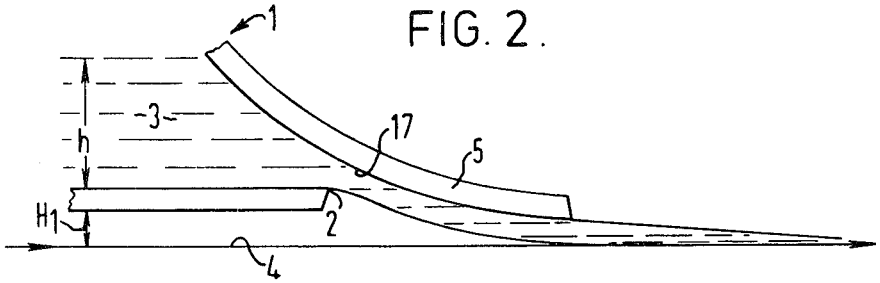
Figure 3:
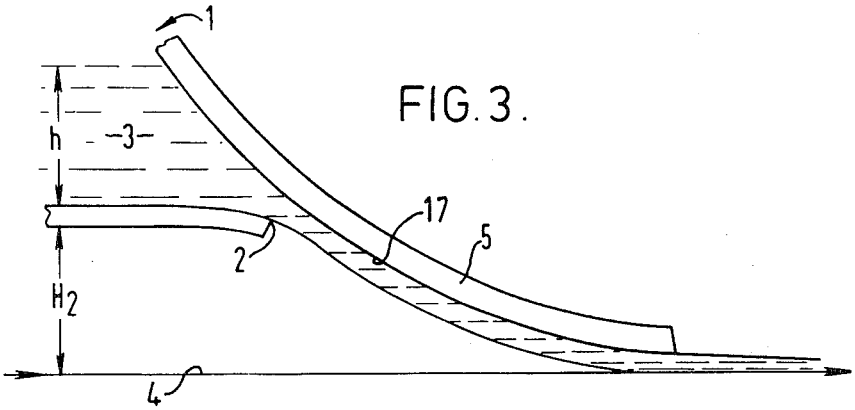

In the apparatus shown in FIG. 2, the guide member 5 is an extension of the top of the outlet 2. Liquid 3 discharged from the outlet along the guide member 5 travels though a vertical distance $h+H_1$, h being equal to the hydrostatic pressure in the reservoir. FIG. 3 shows how apparatus according to the invention can be used to increase jet speed without increasing the pressure in the reservoir. The reservoir is positioned at a height $H_2$ above the moving surface where $H_2$ is greater than $H_1$. The speed of the jet when it reaches the moving surface 4 is thus greater than that of the jet shown in FIG. 2 but h (hydrostatic pressure) remains the same. Such apparatus may therefore be used with advantage in any process involving high-speed controlled liquid deposition such as high-speed production of paper.

Figure 4:
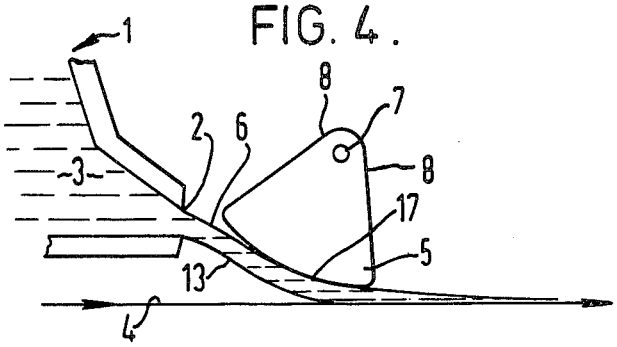

FIG. 4 shows a configuration of apparatus in which the guide member 5 is separate from the reservoir 1. An impermeable web 6 which is concave to the liquid 3 leaving the outlet 2 is provided between the outlet 2 and the guide member 5. The guide member 5, which is convex to the liquid 3, is secured at each end to an arm 8 connected to a shaft 7 which extends transversely to the direction of flow of the liquid 3 and about which the member 5 can pivot. The orientation of the underside 17 of the member 5 relative to the jet and the moving surface 4 can thus be altered. A flexible impermeable apron 13 made from polyester film is attached to the bottom of the outle 2 at one end and is left free at the other end. In use, the apron 13 substantially improves the stability of the jet of liquid 3 by being drawn up by and against the jet.

Figure 5:
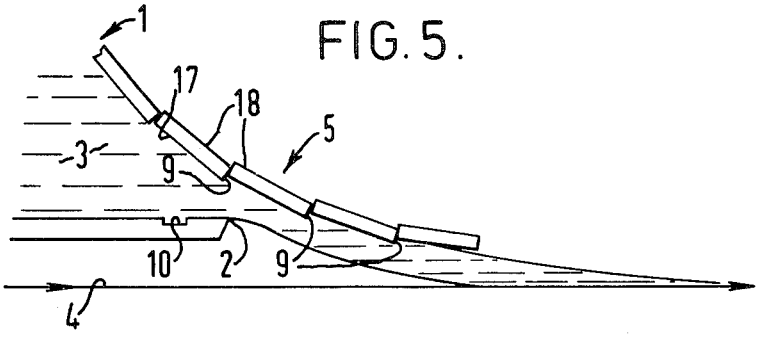
Figure 6:
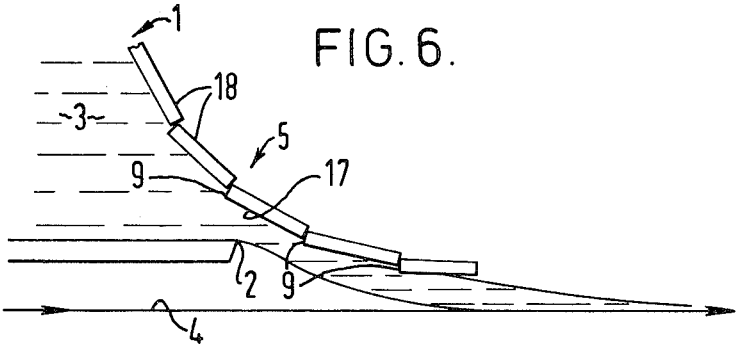

In the apparatus shown in FIGS. 5 and 6, the underside 17 of guide member 5 has a plurality of steps 18 disposed in a direction transverse to the direction of flow of the liquid and arranged so that the surface presented to the jet is overall essentially convex. In use, the steps 18 (particularly those of FIG. 7) encourage the formation of a vortex in the region 9 between successive steps 18. This has the effect of enhancing the tendency of the liquid to flow along the underside 17 of the member 5. In addition, the apparatus of FIG. 5 has a recess 10 in the wall of the outlet 2 over which the liquid flows. The recess 10, which extends transversely to the direction of flow of the liquid, improves the stability of the jet especially during discharge from the outlet 2.

In the apparatus shown in FIG. 7, the underside 17 of the guide member 5 has a plurality of recesses 14 which extend transversely to the direction of flow of the liquid 3. The use of the guide member 5 encourages the formation of vortices in the recesses 14 with a consequent increased tendency for the liquid to flow down and against underside 17.

FIG. 8 illustrates application of the invention to controlled deposition of liquid onto a moving surface that is convex to the liquid. In this case the guide member 5 is concave to the liquid 3.

FIG. 9 shows the wet end of a Fourdrinier paper-making machine 11. Above the machine are suspended two head boxes 1 and 1' each having a slice 2 through which paper-making stock 3 may flow, the machine thus being adapted for the production of a two layered web. Extending from the slice 2 of the second head box 1' is a guide member 5, the slice 2 and the guide member 5 being similar to the outlet 2 and guide member 5 shown in more detail in FIG. 4. The controlled deposition of the stock 3 from the second head box 1' avoids disruption of the partly formed web 12 on the moving wire 4 even if the web 12 is not fully drained or held down by suction.

In FIGS. 10 and 11, there is shown part of a preferred head-box assembly in which a flexible metal guide member 5 is attached to the slice 2. The radius of curvature of the guide member 5 can be altered and an adjustment screw 15 is provided for this purpose. The length of the guide member 5 can also be altered by means of a screw 16. A flexible impermeable apron 13 (not shown in FIG. 10) made from a polyester is attached to the bottom wall of the slice 2 and a reel adjuster 13' is provided to alter the length of the apron 13. A side plate 14 is provided at each side of the guide member 5 and extends downwardly therefrom so as to retain and stabilise the liquid set between the side plates 14. In use, the slice 2 is attached to the head box and paper-making stock 3 enters from the head box as shown by the arrow, passes through the slice 2 and is discharged onto the curved underside 17 of the guide member 5 down which it flows until it is deposited on a moving surface (not shown) below the slice 2. In so doing, the liquid jet draws up the apron 13 against itself thereby improving the stability of the liquid as it flows down the underside 17.

Because the present invention allows a liquid to be deposited in a controlled manner on to a moving surface, a web of paper can now be produced on a Fourdrinier machine with a more random orientation of the fibres on the wire side of the web that has been obtained hitherto with conventional processes and apparatuses for the deposition of paper stock. The problem of curl is thus reduced.

Additionally, the use of the present invention allows the coating or impregnation of a moving web to be carried out with minimal disruption of the web.

The invention will now be illustrated by three examples.

EXAMPLE 1

A Fourdrinier paper-making machine having a head box assembly modified as shown in FIGS. 10 and 11 was used to prepare paper webs from stock which was a mixture of 50% hardwood kraft pulp and 50% softwood kraft pulp beaten to a wetness of 30° on the Schopper-Riegler scale. The slice opening was 15 mm vertically and 5 mm horizontally (distance a and b on FIG. 11), the radius of curvature of the underside of the guide member was 2.5 cm and the distance from the bottom of the slice to the moving wire was 4 cm. The stock was deposited on the wire at 0.45% solids (by weight) and the wire itself was moving at 70 m/min. The paper web formed had a substance of 80 $gm^{-2}$, showed a good formation and was acceptably streak-free.

EXAMPLE 2

A Fourdrinier paper-making machine as shown in FIG. 9 having a second head box assembly modified as shown in FIGS. 10 and 11 was used to prepare two layer paper webs in which the second layer was made from stock of the same composition as that used in example 1 but diluted to a consistency of 0.3% solids (by weight) before deposition. The slice opening was 7 mm vertically, the other dimensions being as for example 1. The stock supplied to the first head box was dyed blue. The two-layer web was dried and the paper produced was found to be acceptably streak-free. The two layers of the web were found to be visually distinct, deposition of the second layer on the first layer having caused substantially no disruption of the first layer.

EXAMPLE 3

The Fourdrinier paper making machine shown in FIG. 9 was used to prepare two-layer paper webs from stock comprising a 50:50 blend by weight of softwood and hardwood pulp, with a loading of Celite[281] (a diatomaceous earth) in the top layer. The resulting two-layered paper had a substance of 40 $gm^{-2}$ and exhibited good properties including good bonding between the layers, the lower of which was not characterised by the disruption associated with two-layer paper webs prepared on a Fourdrinier paper making machine without the use of the present invention.

What is claimed is:

1. Apparatus for controlling the deposition of a liquid on to a moving surface, comprising a reservoir having an outlet, a lower surface of the outlet being adapted to be located above and spaced apart from the moving surface, a guide member downwardly extending from above and adjacent to the outlet and having a convexly curved underside, means for discharging a jet of liquid from the outlet on to the underside of the guide member, the guide member being oriented for allowing the liquid jet to flow unconstrained down the member on the underside and for allowing a lower surface of the jet to be exposed to ambient pressure until the direction of flow of the jet approaches the direction of travel of the moving surface, an end of the guide member remote from the reservoir outlet being adapted to be maintained in a predetermined fixed spaced relationship from the moving surface.

2. Apparatus as claimed in claim 1, wherein the underside of the guide member is plain.

3. Apparatus as claimed in claim 1 or 2, wherein the guide member is a flexible plate whose length and/or radius of curvature is capable of adjustment.

4. Apparatus as claimed in any one of claims 1 or 2 wherein the guide member is mounted pivotally about an axis transverse to the direction of flow of the jet.

5. Apparatus as claimed in any one of claims 1 or 2, wherein a pair of side plates extend downwardly from the guide member so as to retain the liquid between the two side plates.

6. A head box assembly for controlling the deposition of a liquid on to a moving wire of a paper making machine, comprising a head box having a slice, a lower surface of the slice being adapted to be located above and spaced apart from the moving wire, a guide member downwardly extending from above and adjacent to the slice and having a convexly curved underside, means for discharging a jet of paper making stock from the slice on to the underside of the guide member, the guide member being oriented for allowing the liquid jet to flow unconstrained down the member on the underside and for allowing a lower surface of the jet to be exposed to ambient pressure until the direction of flow of the jet approaches the direction of travel of the moving wire, an end of the guide member remote from the slice adapted to be maintained in a predetermined fixed spaced relationship from the moving wire.

7. An apparatus for preparing a multi-layer paper, comprising a wire for carrying a paper web, means for moving said wire, a headbox having an outlet, a lower surface of said outlet being arranged above and spaced apart from the moving wire, a guide member downwardly extending from above and adjacent to the outlet and having a convexly curved underside surface, an end of the guide member remote from the outlet being maintained in a predetermined fixed spaced relationship from the moving wire, means for discharging a jet of liquid from the outlet onto the underside of the guide member, the guide member being oriented such that the jet flows unconstrained down the member on the underside with a lower surface of the jet being exposed to ambient pressure until the direction of flow of the jet approaches the direction of travel of the moving wire to thereby deposit the liquid onto the moving paper web to form a multi-layer paper.

* * * * *